US011227555B2

(12) United States Patent
Park et al.

(10) Patent No.: US 11,227,555 B2
(45) Date of Patent: Jan. 18, 2022

(54) DISPLAY DEVICE PERFORMING ADAPTIVE REFRESH

(71) Applicant: Samsung Display Co., Ltd., Yongin-Si (KR)

(72) Inventors: Se Hyuk Park, Seongnam-si (KR); Hong Soo Kim, Hwaseong-si (KR); Jin Young Roh, Hwaseong-si (KR); Hyo Jin Lee, Seongnam-si (KR); Jae Keun Lim, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/171,428

(22) Filed: Feb. 9, 2021

(65) Prior Publication Data

US 2021/0335275 A1 Oct. 28, 2021

(30) Foreign Application Priority Data

Apr. 22, 2020 (KR) ..... 10-2020-0048809

(51) Int. Cl.
*G09G 3/3275* (2016.01)

(52) U.S. Cl.
CPC ..... *G09G 3/3275* (2013.01); *G09G 2320/10* (2013.01); *G09G 2360/12* (2013.01)

(58) Field of Classification Search
CPC ..... G09G 2330/021; G09G 2340/0435; G09G 2320/0247; G09G 3/3275; G09G 2320/10; G09G 2360/12
See application file for complete search history.

(56) References Cited

U.S. PATENT DOCUMENTS 7,508,366 B2 * 3/2009 Shiomi ..... G09G 3/3648 345/87
2011/0175878 A1 * 7/2011 Hsiao ..... G09G 3/3677 345/211

FOREIGN PATENT DOCUMENTS

KR 101255701 B1 4/2013
KR 1020150080103 A 7/2015
KR 1020170080793 A 7/2017
KR 1020180032740 A 4/2018

* cited by examiner

*Primary Examiner* — Koosha Sharifi-Tafreshi
(74) *Attorney, Agent, or Firm* — Cantor Colburn LLP

(57) ABSTRACT

A display device includes a display panel including a plurality of pixels, a data driver which provides data signals to the plurality of pixels, and a controller which controls the data driver. The controller writes frame data to a frame memory, reads the frame data in each of a plurality of frame periods, performs in a first frame period of the plurality of frame periods a still image detection operation that determines whether the frame data represent a still image, and does not performs the still image detection operation in a second frame period of the plurality of frame periods subsequent to the first frame period.

20 Claims, 12 Drawing Sheets

FIG. 8

| GRAY LEVEL | FLICKER VALUE | FREQUENCY(Hz) |
|---|---|---|
| 0-3 | 0 | 1 |
| 4-7 | 0 | 1 |
| 8-11 | 40 | 2 |
| 12-15 | 80 | 5 |
| 16-19 | 120 | 10 |
| 20-23 | 160 | 30 |
| 24-27 | 200 | 60 |
| ⋮ | ⋮ | ⋮ |
| 236-239 | 0 | 1 |
| 240-243 | 0 | 1 |
| 244-247 | 0 | 1 |
| 248-251 | 0 | 1 |
| 252-255 | 0 | 1 |

DISPLAY DEVICE PERFORMING ADAPTIVE REFRESH

This application claims priority to Korean Patent Application No. 10-2020-0048809, filed on Apr. 22, 2020, and all the benefits accruing therefrom under 35 U.S.C. § 119, the content of which in its entirety is herein incorporated by reference.

BACKGROUND

1. Field

Embodiments of the present inventive concept relate to a display device, and more particularly to a display device performing adaptive refresh.

2. Description of the Related Art

Reduction of power consumption may be desirable in a display device employed in a portable device, such as a smartphone, a tablet computer, etc., for example, in order to extend battery life. In order to reduce the power consumption of the display device, a low frequency driving technique (e.g., an adaptive refresh technique or an adaptive refresh panel ("ARP") technique) which drives or refreshes a display panel at a frequency lower than a normal driving frequency by analyzing image data has been developed.

SUMMARY

In a mode (e.g., a command mode of a mobile industry processor interface ("MIPI")) where an input frame frequency is lower than a driving frequency for the display panel, the low frequency driving technique or the ARP technique may not be efficiently performed.

Some embodiments provide a display device capable of efficiently performing an adaptive refresh panel ("ARP") technique.

Some embodiments provide a method of operating a display device capable of efficiently performing an ARP technique.

According to embodiments, there is provided a display device including a display panel including a plurality of pixels, a data driver which provides data signals to the plurality of pixels, and a controller which controls the data driver. to the controller writes frame data to a frame memory, reads the frame data in each of a plurality of frame periods, performs in a first frame period of the plurality of frame periods a still image detection operation that determines whether the frame data represent a still image, and does not perform the still image detection operation in a second frame period of the plurality of frame periods subsequent to the first frame period.

In embodiments, in the first frame period, the controller may selectively perform a driving frequency decision operation that decides a driving frequency for the display panel by analyzing the frame data according to a result of the still image detection operation. In the second frame period, the controller may perform the driving frequency decision operation without performing the still image detection operation.

In embodiments, the controller may include a receiving block which receives the frame data, the frame memory which stores the frame data, and an adaptive refresh panel block. In each frame period in a first mode and the first frame period in a second mode, the adaptive refresh panel block may perform the still image detection operation for the frame data, and may selectively perform a driving frequency decision operation that decides a driving frequency for the display panel by analyzing the frame data according to a result of the still image detection operation. In the second frame period in the second mode, the adaptive refresh panel block may not perform the still image detection operation for the frame data, and may perform the driving frequency decision operation for the frame data.

In embodiments, in the first mode, the receiving block may receive the frame data at a first frame frequency, and may not write the frame data to the frame memory. In the first mode, the adaptive refresh panel block may receive the frame data at the first frame frequency directly from the receiving block. In the second mode, the receiving block may receive the frame data at a second frame frequency lower than the first frame frequency, and may write the frame data at the second frame frequency to the frame memory. In the second mode, the adaptive refresh panel block may read the frame data at the first frame frequency from the frame memory.

In embodiments, the first mode may be a video mode, and the second mode may be a command mode.

In embodiments, the controller may further include a still image detection flag block which generates a still image detection flag signal having a first logic level in each frame period in the first mode and the first frame period in the second mode, and generates the still image detection flag signal having a second logic level in the second frame period in the second mode.

In embodiments, the adaptive refresh panel block may perform the still image detection operation for the frame data in response to the still image detection flag signal having the first logic level, and may not perform the still image detection operation for the frame data in response to the still image detection flag signal having the second logic level.

In embodiments, the adaptive refresh panel block may include a still image detection block which performs the still image detection operation that determines whether the frame data represent the still image by comparing the frame data in a current frame period and the frame data in a previous frame period in response to the still image detection flag signal having a first logic level, and generates a still flag signal having the first logic level when the frame data represent the still image, and a driving frequency decision block which performs the driving frequency decision operation that decides the driving frequency for the display panel by analyzing the frame data in response to the still image detection flag signal having the second logic level or the still flag signal having the first logic level.

In embodiments, the driving frequency decision block may not perform the driving frequency decision operation in response to the still image detection flag signal having the first logic level and the still flag signal having a second logic level.

In embodiments, the still image detection block may generate the still flag signal having the first logic level when the frame data in the current frame period are substantially the same as the frame data in the previous frame period, and may generate the still flag signal having the second logic level when the frame data in the current frame period are different from the frame data in the previous frame period.

In embodiments, when the still image detection flag signal has the first logic level, and the still flag signal has the second logic level, the driving frequency decision block may provide the frame data to the data driver without performing the driving frequency decision operation. When the still image detection flag signal has the second logic level, or the still flag signal has the first logic level, the driving frequency decision block may selectively provide the frame data to the data driver according to the driving frequency determined by the driving frequency decision operation.

In embodiments, the driving frequency decision block may include a flicker lookup table which stores flicker values corresponding to gray levels, a segment division block which divides the frame data into a plurality of segment data for a plurality of segments, respectively, a segment frequency decision block which determines a plurality of segment flicker values corresponding to gray levels of the plurality of segment data by using the flicker lookup table, and determines a plurality of segment frequencies for the plurality of segments according to the plurality of segment flicker values, respectively, and a maximum frequency decision block which decides a maximum segment frequency of the plurality of segment frequencies as the driving frequency for the display panel.

In embodiments, the still image detection flag block may provide the adaptive refresh panel block with frame repetition number information representing the number of the plurality of frame periods in which the same frame data are read from the frame memory.

In embodiments, in providing the frame repetition number information to the adaptive refresh panel block, the still image detection flag block may provide the adaptive refresh panel block with the still image detection flag signal including pulses of which the number corresponds to the number of the plurality of frame periods.

In embodiments, the driving frequency decision block may include a flicker lookup table which stores flicker values corresponding to gray levels, a segment division block which divides the frame data into a plurality of segment data for a plurality of segments, respectively, a segment frequency decision block which determines a plurality of segment flicker values corresponding to gray levels of the plurality of segment data by using the flicker lookup table, and determines a plurality of segment frequencies for the plurality of segments according to the plurality of segment flicker values, respectively, a maximum frequency decision block which decides a maximum segment frequency of the plurality of segment frequencies, and a final frequency decision block which decides the driving frequency for the display panel based on the frame repetition number information and the maximum segment frequency.

In embodiments, the final frequency decision block may decide a frame change frequency by dividing a normal driving frequency by the number of the plurality of frame periods represented by the frame repetition number information, and may decide a higher one of the maximum segment frequency and the frame change frequency as the driving frequency for the display panel.

In embodiments, the adaptive refresh panel block may further include a driving frequency mixing block which gradually changes the driving frequency for the display panel from a previous driving frequency to a current driving frequency when the current driving frequency decided by the driving frequency decision operation is different from the previous driving frequency for the display panel.

According to embodiments, there is provided a display device including a display panel including a plurality of pixels, a data driver which provides data signals to the plurality of pixels, and a controller which controls the data driver. The controller includes a frame memory, a receiving block which receives frame data at a first frame frequency in a first mode, receives the frame data at a second frame frequency lower than the first frame frequency in a second mode, and writes the frame data at the second frame frequency to the frame memory in the second mode, and an adaptive refresh panel block which receives the frame data at the first frame frequency from the receiving block in the first mode, reads the frame data at the first frame frequency from the frame memory in the second mode, performs a still image detection operation that determines whether the frame data represent a still image in each frame period in the first mode and in a first frame period of a plurality of frame periods in the second mode, and does not perform the still image detection operation for the frame data in a second frame period of the plurality of frame periods subsequent to the first frame period in the second mode.

In embodiments, in each frame period in the first mode and in the first frame period in the second mode, the adaptive refresh panel block may selectively perform a driving frequency decision operation that decides a driving frequency for the display panel by analyzing the frame data according to a result of the still image detection operation. In the second frame period in the second mode, the adaptive refresh panel block may perform the driving frequency decision operation without performing the still image detection operation.

According to embodiments, there is provided a method of operating a display device. In the method, frame data are received at a first frame frequency in a first mode, a still image detection operation that determines whether the frame data represent a still image is performed in the first mode, a driving frequency decision operation that decides a driving frequency for a display panel by analyzing the frame data is selectively performed according to a result of the still image detection operation in the first mode, the frame data are received at a second frame frequency lower than the first frame frequency in a second mode, the frame data are written at the second frame frequency to a frame memory in the second mode, the frame data are read at the first frame frequency from the frame memory in the second mode, the still image detection operation for the frame data read from the frame memory is performed in a first frame period of a plurality of frame periods in the second mode, the driving frequency decision operation is selectively performed according to a result of the still image detection operation in the first frame period in the second mode, and the driving frequency decision operation is performed without performing the still image detection operation in a second frame period of the plurality of frame periods subsequent to the first frame period in the second mode.

As described above, in a display device and a method of operating the display device according to embodiments, frame data may be written to a frame memory, the frame data may be read from the frame memory in each of a plurality of frame periods, a still image detection operation that determines whether the frame data represent a still image may be performed in a first frame period of the plurality of frame periods, and the still image detection operation for the frame data may not be performed in a second frame period of the plurality of frame periods subsequent to the first frame period. Accordingly, the unnecessary still image detection operation may not be performed, and an adaptive refresh panel (ARP) technique may be more efficiently performed.

BRIEF DESCRIPTION OF THE DRAWINGS

Illustrative, non-limiting embodiments will be more clearly understood from the following detailed description in conjunction with the accompanying drawings.

FIG. 8 is a diagram illustrating an example of a flicker lookup table included in a display device according to embodiments.

DETAILED DESCRIPTION

Hereinafter, embodiments of the present inventive concept will be explained in detail with reference to the accompanying drawings. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
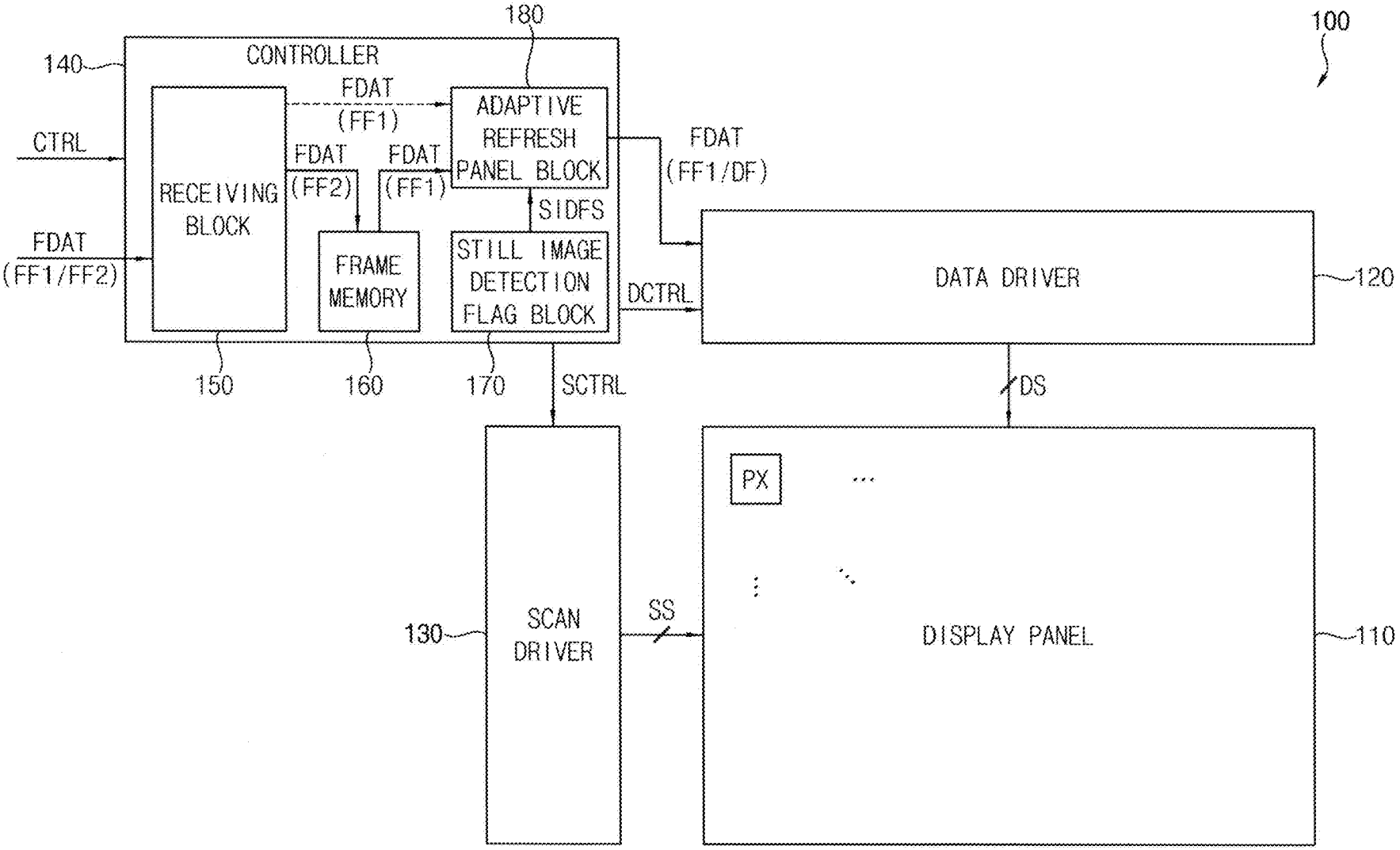
FIG. 1 is a block diagram illustrating a display device according to embodiments.
Figure 2:
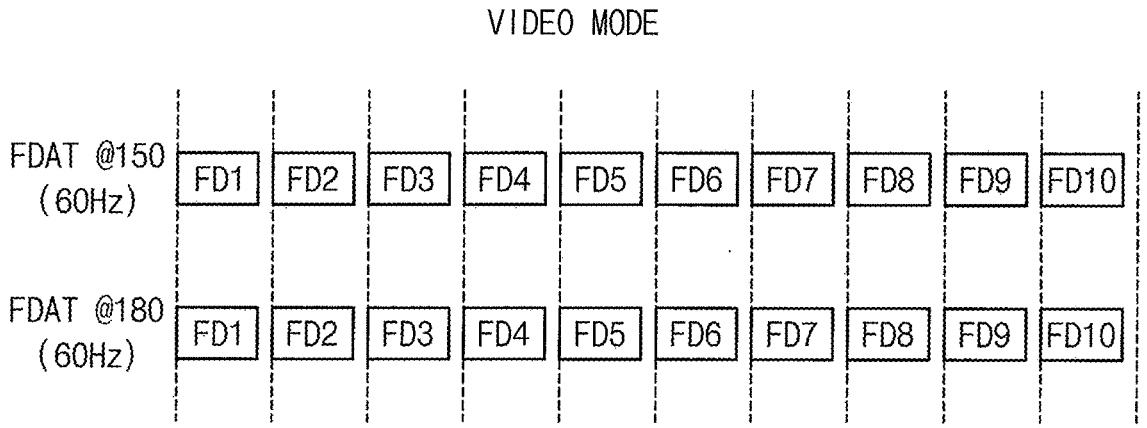
FIG. 2 is a diagram illustrating an example of frame data in a first mode.
Figure 3:
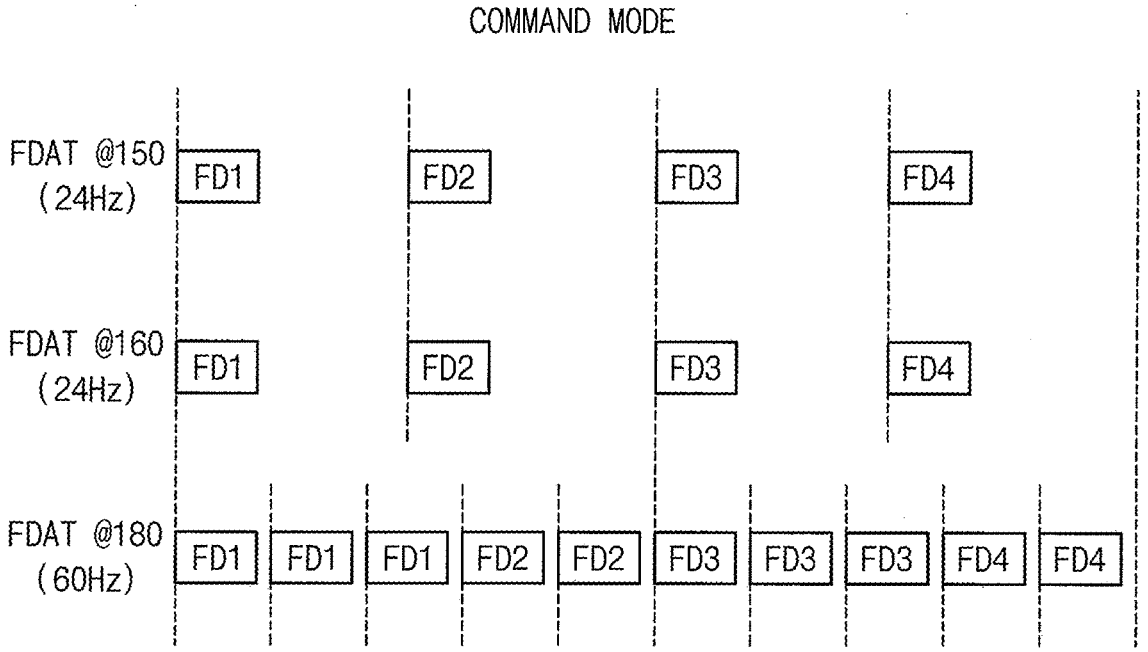
FIG. 3 is a diagram illustrating an example of frame data in a second mode.
Figure 4:
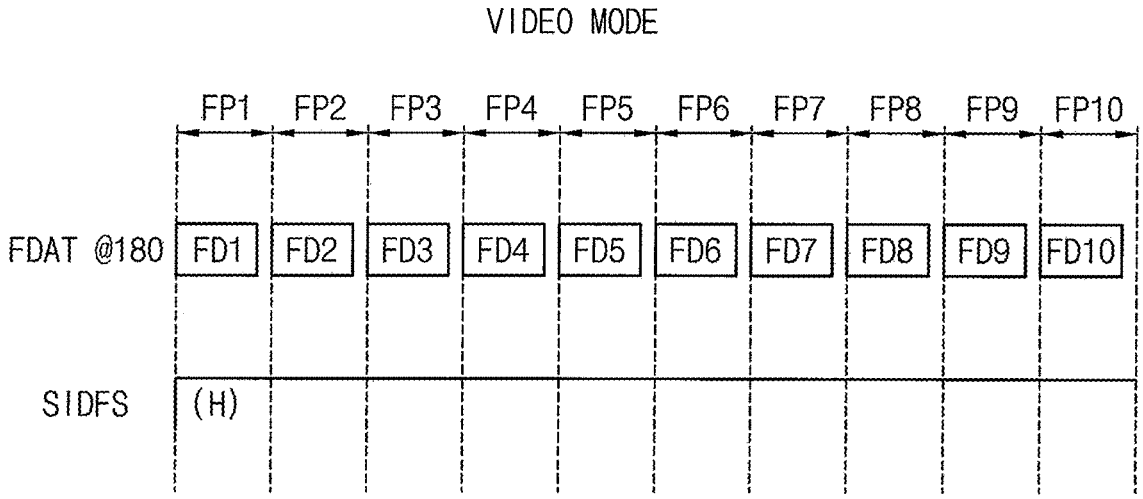
FIG. 4 is a diagram illustrating an example of a still image detection signal in a first mode.
Figure 5:
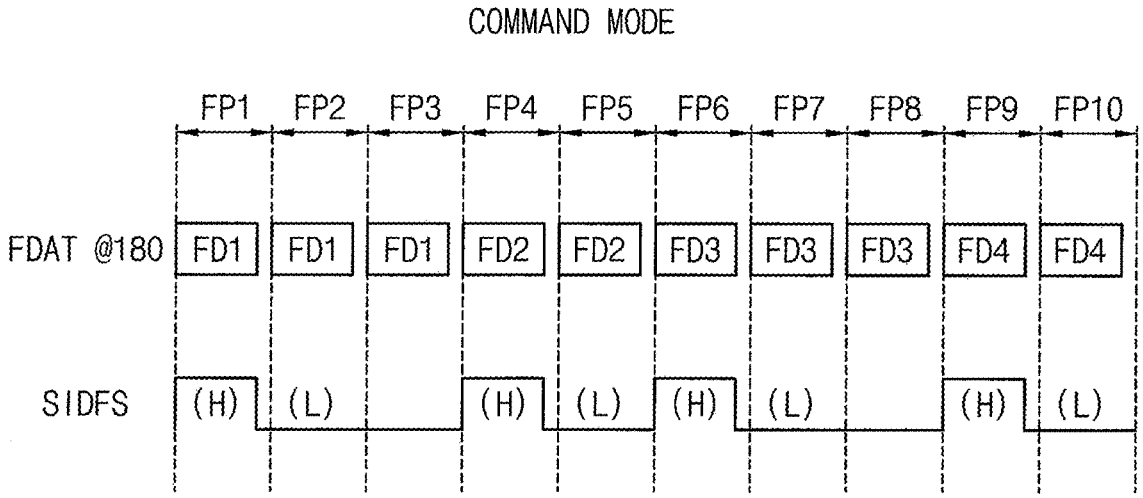
FIG. 5 is a diagram illustrating an example of a still image detection signal in a second mode.

FIG. 1 is a block diagram illustrating a display device according to embodiments, FIG. 2 is a diagram illustrating an example of frame data in a first mode, FIG. 3 is a diagram illustrating an example of frame data in a second mode, FIG. 4 is a diagram illustrating an example of a still image detection signal in a first mode, and FIG. 5 is a diagram illustrating an example of a still image detection signal in a second mode.

Referring to FIG. 1, a display device 100 according to embodiments may include a display panel 110 that includes a plurality of pixels PX, a data driver 120 that provides data signals DS to the plurality of pixels PX, a scan driver 130 that provides scan signals SS to the plurality of pixels PX, and a controller 140 that controls the data driver 120 and the scan driver 130.

The display panel 110 may include a plurality of data lines, a plurality of scan lines, and the plurality of pixels PX coupled to the plurality of data lines and the plurality of scan lines. In some embodiments, each pixel PX may include at least one capacitor, at least two transistors and an organic light emitting diode ("OLED"), and the display panel 110 may be an OLED display panel. Further, in some embodiments, each pixel PX may be a hybrid pixel suitable for low frequency driving for reducing power consumption. For example, in the hybrid pixel, a driving transistor may be implemented with a low-temperature polycrystalline silicon ("LTPS") PMOS transistor, and a switching transistor may be implemented with an oxide NMOS transistor. In other embodiments, the display panel 110 may be a liquid crystal display ("LCD") panel, or any other suitable display panel.

The data driver 120 may generate the data signals DS based on frame data FDAT and a data control signal DCTRL received from the controller 140, and may provide the data signals DS to the plurality of pixels PX through the plurality of data lines. In some embodiments, the data driver 120 may receive the frame data FDAT at a first frame frequency FF1 (e.g., a normal driving frequency) from the controller 140 (specifically, an adaptive refresh panel block 180), or may receive the frame data FDAT at a driving frequency DF decided by a driving frequency decision operation of the adaptive refresh panel block 180 from the controller 140 (specifically, the adaptive refresh panel block 180). The driving frequency DF decided by the driving frequency decision operation may be lower than the first frame frequency FF1 (e.g., the normal driving frequency), and thus power consumption of the display device 100 may be reduced when driven at the driving frequency DF rather than at the first frame frequency FF1. Further, in some embodiments, the data control signal DCTRL may include, but not limited to, an output data enable signal, a horizontal start signal, and a load signal. In some embodiments, the data driver 120 and the controller 140 may be implemented with a single integrated circuit, and the integrated circuit may be referred to as a timing controller-embedded data driver ("TED"). In other embodiments, the data driver 120 and the controller 140 may be implemented with separate integrated circuits from each other.

The scan driver 130 may generate the scan signals SS based on a scan control signal SCTRL received from the controller 140, and may provide the scan signals SS to the plurality of pixels PX through the plurality of scan lines. In some embodiments, the scan driver 130 may sequentially provide the scan signals SS to the plurality of pixels PX on a row-by-row basis. Further, in some embodiments, the scan control signal SCTRL may include, but not limited to, a scan start signal and a scan clock signal. In some embodiments, the scan driver 130 may be integrated or disposed in a peripheral portion of the display panel 110. In other embodiments, the scan driver 130 may be implemented with one or more integrated circuits.

The controller 140 (e.g., a timing controller ("TCON")) may receive the frame data FDAT and a control signal CTRL from an external host processor (e.g., an application processor ("AP"), a graphic processing unit ("GPU") or a graphic card). In some embodiments, the frame data FDAT may be an RGB image data including red (R) image data, green (G) image data, and blue (B) image data. Further, in some embodiments, the control signal CTRL may include, but not limited to, a vertical synchronization signal, a horizontal synchronization signal, an input data enable signal, a master clock signal, etc. The controller 140 may control an operation of the data driver 120 by providing the frame data FDAT and the data control signal DCTRL to the data driver 120, and may control an operation of the scan driver 130 by providing the scan control signal SCTRL to the scan driver 130.

In the display device 100 according to embodiments, the controller 140 may receive the frame data FDAT at the first frame frequency FF1 from the host processor in a first mode, and may receive the frame data FDAT at a second frame frequency FF2 lower than the first frame frequency FF1 from the host processor in a second mode. In some embodiments, the first frame frequency FF1 may be the normal driving frequency for the display device 100, and may be, but not limited to, about 60 Hertz (Hz) or about 120 Hz. Further, for example, the second frame frequency FF2 may be, but not limited to, about 24 Hz. Since the frame data FDAT are received at the second frame frequency FF2 lower than the first frame frequency FF1 in the second mode, the power consumption of an interface between the host processor and the display device 100 may be reduced in the second mode. In some embodiments, the first mode according to the invention may be, but not limited to, a video mode of a mobile industry processor interface ("MIPI"), and the second mode according to the invention may be, but not limited to, a command mode of the MIPI.

Further, since the frame data FDAT are received at the second frame frequency FF2 lower than the first frame frequency FF1 (e.g., the normal driving frequency) in the second mode, the controller 140 may write the frame data FDAT at the second frame frequency FF2 to a frame memory 160, and may read the frame data FDAT at the first frame frequency FF1 from the frame memory 160. In some embodiments, the controller 140 may include a receiving block 150 for receiving the frame data FDAT, the frame memory 160 for storing the frame data FDAT, and an adaptive refresh panel block 180 for performing a low frequency driving technique or an adaptive refresh panel ("ARP") technique.

In the first mode, the receiving block 150 may receive the frame data FDAT at the first frame frequency FF1, and may not write the frame data FDAT to the frame memory 160. Further, in the first mode, the adaptive refresh panel block 180 may receive the frame data FDAT at the first frame frequency FF1 directly from the receiving block 150. For example, as illustrated in FIG. 2, in the first mode, for example in the video mode, while the receiving block 150 receives first through tenth frame data FD1 through FD10 at the first frame frequency FF1 (e.g., about 60 Hz), the adaptive refresh panel block 180 may directly receive the first through tenth frame data FD1 through FD10 at the first frame frequency FF1 (e.g., about 60 Hz) from the receiving block 150. Here, in the figures, @ means 'at'. For example, @150 means 'at the receiving block 150'.

In the second mode, the receiving block 150 may receive the frame data FDAT at the second frame frequency FF2 lower than the first frame frequency FF1, and may write the frame data FDAT at the second frame frequency FF2 to the frame memory 160. Further, in the second mode, the adaptive refresh panel block 180 may read the frame data FDAT at the first frame frequency FF1 from the frame memory 160. Thus, in the second mode, a write operation for the frame memory 160 may be performed at the second frame frequency FF2, and a read operation for the frame memory 160 may be performed at the first frame frequency FF1. For example, as illustrated in FIG. 3, in the second mode, for example in the command mode, the receiving block 150 may receive first through fourth frame data FD1 through FD4 at the second frame frequency FF2 (e.g., about 24 Hz), and may write the first through fourth frame data FD1 through FD4 at the second frame frequency FF2 (e.g., about 24 Hz) to the frame memory 160. While the first through fourth frame data FD1 through FD4 are written to the frame memory 160, the adaptive refresh panel block 180 may read the first through fourth frame data FD1 through FD4 at the first frame frequency FF1 (e.g., about 60 Hz) from the frame memory 160. Thus, the adaptive refresh panel block 180 may read the first frame data FD1 three times during three frame periods, may read the second frame data FD2 twice during two frame periods, may read the third frame data FD3 three times during three frame periods, and may read the fourth frame data FD4 twice during two frame periods when the first frame frequency FF1 is 60 Hz and the second frame frequency FF2 is 24 Hz, for example.

In each frame period in the first mode, the adaptive refresh panel block 180 may perform a still image detection operation that determines whether the frame data FDAT represent a still image, and may selectively perform a driving frequency decision operation that decides the driving frequency DF for the display panel 110 by analyzing the frame data FDAT according to a result of the still image detection operation.

For example, in a case where it is determined that the frame data FDAT do not represent the still image, or in a case where it is determined that the frame data FDAT represent a moving image, the adaptive refresh panel block 180 may not perform the driving frequency decision operation, and may provide the frame data FDAT at the first frame frequency FF1 (e.g., the normal driving frequency) to the data driver 120. Thus, the data driver 120 may drive the display panel 110 at the first frame frequency FF1 (e.g., the normal driving frequency).

Alternatively, in a case where it is determined that the frame data FDAT represent the still image, the adaptive refresh panel block 180 may perform the driving frequency decision operation, and may provide the frame data FDAT at the driving frequency DF decided by the driving frequency decision operation. Thus, the data driver 120 may drive the display panel 110 at the driving frequency DF decided by the driving frequency decision operation. The driving frequency DF may be a low frequency lower than the first frame frequency FF1 (e.g., the normal driving frequency). Accordingly, since the display panel 110 is driven at the low frequency (i.e., the driving frequency DF), the power consumption of the display device 100 may be reduced.

In the second mode, a plurality of consecutive frame periods may exist in each of which the adaptive refresh panel block 180 reads the same frame data FDAT from the frame memory 160. For example, as explained above, the adaptive refresh panel block 180 may read the first frame data FD1 three times during each of the first to third frame periods FP1 to FP3 (See FIG. 5). In a first frame period of the plurality of consecutive frame periods, the adaptive refresh panel block 180 may perform the still image detection operation for the frame data FDAT, and may selectively performs the driving frequency decision operation for the frame data FDAT according to a result of the still image detection operation. The adaptive refresh panel block 180 may provide the frame data FDAT to the data driver 120 at the first frame frequency FF1 in a case where the frame data FDAT are determined not to represent the still image, and may selectively provide the frame data FDAT to the data driver 120 at the driving frequency DF decided by the driving frequency decision operation in a case where the frame data FDAT are determined to represent the still image.

Further, in the remaining frame periods in the plurality of consecutive frame periods (including a second frame period of the plurality of consecutive frame periods subsequent to the first frame period), the adaptive refresh panel block 180 may not perform the still image detection operation for the frame data FDAT, and may perform the driving frequency decision operation for the frame data FDAT. Further, the adaptive refresh panel block 180 may provide the frame data FDAT to the data driver 120 at the driving frequency DF decided by the driving frequency decision operation. As described above, since the still image detection operation may be performed only in the first frame period of the plurality of consecutive frame periods where the same frame data FDAT are read in the second mode, and may not be performed in at least one subsequent second frame period of the plurality of consecutive frame periods, the unnecessary still image detection operation may be omitted, and, therefore, a low frequency driving technique or an adaptive refresh panel (ARP) technique may be more efficiently performed.

In order that the adaptive refresh panel block 180 performs the still image detection operation in each frame period in the first mode and the first frame period in the second mode, and does not perform the still image detection operation in the remaining frame periods in the plurality of consecutive frame periods in the second mode, the controller 140 may further include a still image detection flag block 170. In some embodiments, the still image detection flag block 170 may generate a still image detection flag signal SIDFS having a first logic level in each frame period in the first mode and the first frame period in the second mode, and may generate the still image detection flag signal SIDFS having a second logic level in the remaining frame periods (including the second frame period) of the plurality of consecutive frame periods in the second mode.

For example, as illustrated in FIG. 4, in the video mode (i.e., the first mode), during first through tenth frame periods FP1 through FP10 in which the adaptive refresh panel block 180 receives the first through tenth frame data FD1 through FD10, respectively, the still image detection flag block 170 may generate the still image detection flag signal SIDFS having the first logic level, (e.g., a high level H).

Further, for example, as illustrated in FIG. 5, in the command mode (i.e., the second mode), the still image detection flag block 170 may generate the still image detection flag signal SIDFS having the first logic level (i.e., the high level H) in a first frame period FP1 among first through third frame periods FP1, FP2 and FP3 in which the adaptive refresh panel block 180 receives first frame data FD1, and may generate the still image detection flag signal SIDFS having the second logic level (i.e., a low level L) in the subsequent second and third frame periods FP2 and FP3 among first through third frame periods FP1, FP2 and FP3. Further, the still image detection flag block 170 may generate the still image detection flag signal SIDFS having the first logic level (i.e., the high level H) in fourth, sixth and ninth frame periods FP4, FP6 and FP9, and may generate the still image detection flag signal SIDFS having the second logic level (i.e., the low level L) in fifth, seventh, eighth and tenth frame periods FP5, FP7, FP8 and FP10.

The adaptive refresh panel block 180 may perform the still image detection operation for the frame data FDAT in response to the still image detection flag signal SIDFS having the first logic level (e.g., the high level H), and may not perform the still image detection operation for the frame data FDAT in response to the still image detection flag signal SIDFS having the second logic level (e.g., a low level L). Thus, the adaptive refresh panel block 180 may perform the still image detection operation in response to the still image detection flag signal SIDFS having the first logic level (e.g., the high level H) in each frame period in the first mode and the first frame period in the second mode, and may not perform the still image detection operation in response to the still image detection flag signal SIDFS having the second logic level (e.g., a low level L) in the remaining frame periods (including the second frame period) of the plurality of consecutive frame periods in the second mode. Accordingly, in the second mode, the unnecessary still image detection operation may not be performed, and the low frequency driving technique or the ARP technique may be more efficiently performed.

As described above, in the display device 100 according to embodiments, the frame data FDAT in the second mode may be written to the frame memory 160, the frame data FDAT may be read from the frame memory 160 in each of the plurality of consecutive frame periods, the still image detection operation that determines whether the frame data FDAT represent the still image may be performed in the first frame period of the plurality of consecutive frame periods, and the still image detection operation for the frame data FDAT may not be performed in the remaining frame periods in the plurality of consecutive frame periods (e.g., the subsequent second frame period of the plurality of consecutive frame periods). Accordingly, the unnecessary still image detection operation may be skipped during the remaining frame periods of the plurality of consecutive frame periods, and the low frequency driving technique or the ARP technique may be more efficiently performed.

Figure 6:
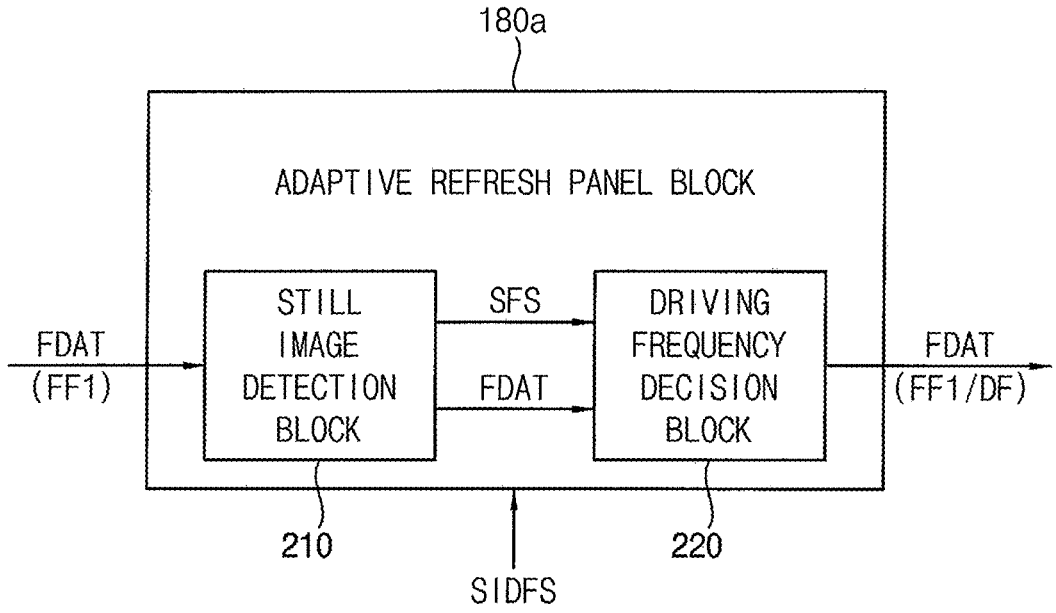
FIG. 6 is a block diagram illustrating an adaptive refresh panel block included in a display device according to embodiments.
Figure 7:
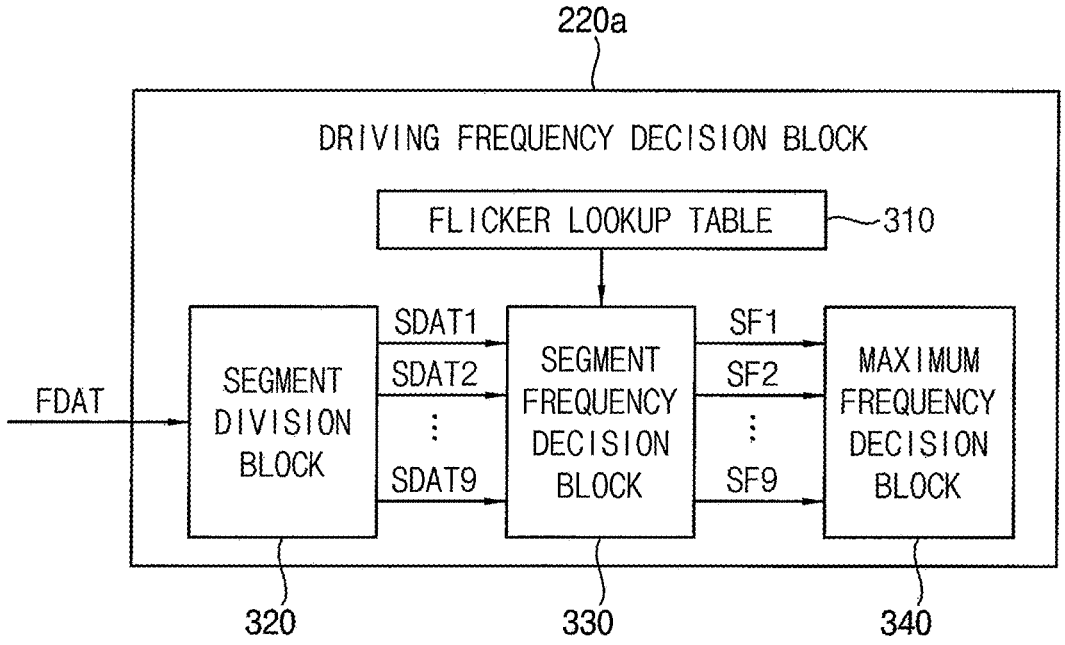
FIG. 7 is a block diagram illustrating a driving frequency decision block included in a display device according to another embodiment.
Figure 9:
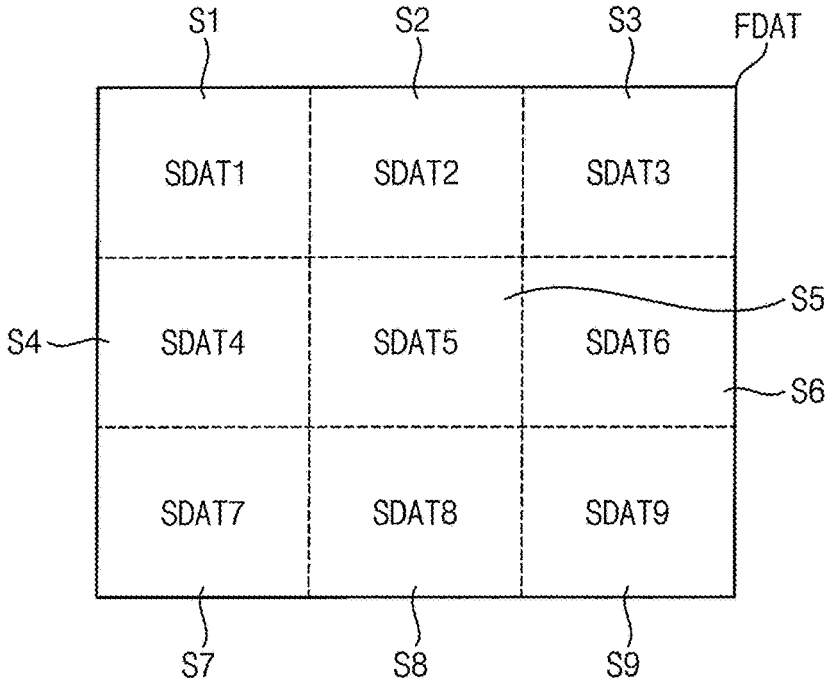
FIG. 9 is a diagram for describing an example of an operation of a segment division block included in a display device according to embodiments.
Figure 10:
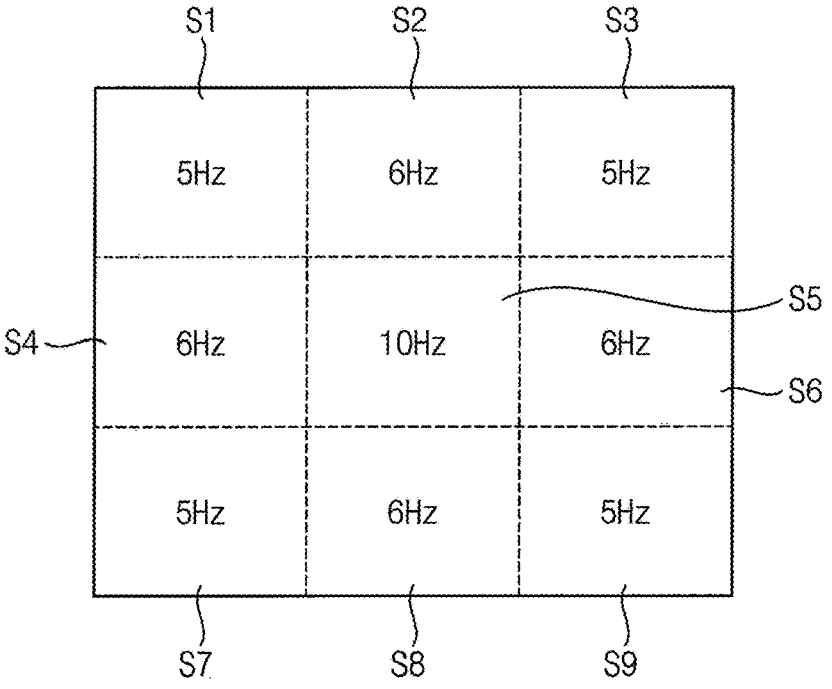
FIG. 10 is a diagram for describing an example of an operation of a segment frequency decision block included in a display device according to embodiments.

FIG. 6 is a block diagram illustrating an adaptive refresh panel block included in a display device according to embodiments, FIG. 7 is a block diagram illustrating a driving frequency decision block included in a display device according to another embodiment, FIG. 8 is a diagram illustrating an example of a flicker lookup table included in a display device according to embodiments, FIG. 9 is a diagram for describing an example of an operation of a segment division block included in a display device according to embodiments, and FIG. 10 is a diagram for describing an example of an operation of a segment frequency decision block included in a display device according to embodiments.

Referring to FIG. 6, an adaptive refresh panel block 180*a* included in a display device according to embodiments may include a still image detection block 210 and a driving frequency decision block 220.

The still image detection block 210 may selectively perform a still image detection operation that determines whether frame data FDAT represent a still image in response to a still image detection flag signal SIDFS. The still image detection block 210 may receive the still image detection flag signal SIDFS having a first logic level (e.g., a high level) in a first mode (e.g., a video mode), may receive the still image detection flag signal SIDFS having the first logic level (e.g., the high level) in a first frame period among a plurality of consecutive frame periods in which the same frame data FRAME are read from the frame memory 160 in a second mode (e.g., a command mode), and may receive the still image detection flag signal SIDFS having a second logic level (e.g. a low level) in the remaining frame periods among the plurality of consecutive frame periods in the second mode.

In some embodiments, the still image detection block 210 may perform the still image detection operation for the frame data FDAT by comparing the frame data FDAT in a current frame period and the frame data FDAT in a previous frame period in response to the still image detection flag signal SIDFS having the first logic level (e.g., the high level). For example, the still image detection block 210 may compare all pixel image data included in the frame data FDAT in the current frame period and all pixel image data included in the frame data FDAT in the previous frame period, respectively. In another example, the still image detection block 210 may compare a representative value (e.g., an average value, a checksum value, etc.) of the frame data FDAT in the current frame period and a representative value of the frame data FDAT in the previous frame period. Further, the still image detection block 210 may generate a still flag signal SFS having the first logic level (e.g., the high level) which represents that the frame data FDAT represent the still image when the frame data FDAT in the current frame period are substantially the same as the frame data FDAT in the previous frame period, and may generate the still flag signal SFS having the second logic level (e.g., the low level) which represents that the frame data FDAT do not represent the still image when the frame data FDAT in the current frame period are different from the frame data FDAT in the previous frame period. Further, the still image detection block 210 may not perform the still image detection operation for the frame data FDAT in response to the still image detection flag signal SIDFS having the second logic level (e.g., the low level)

The driving frequency decision block 220 may perform a driving frequency decision operation that decides a driving frequency DF for a display panel by analyzing the frame data FDAT in response to the still image detection flag signal SIDFS having the second logic level (e.g., the low level) or the still flag signal SFS having the first logic level (e.g., the high level), and may not perform the driving frequency decision operation for the frame data FDAT in response to the still image detection flag signal SIDFS having the first logic level (e.g., the high level) and the still flag signal SFS having the second logic level (e.g., the low level). Thus, when the still image detection flag signal SIDFS has the first logic level, and the still flag signal SFS has the second logic level, the driving frequency decision block 220 may provide the frame data FDAT to a data driver without performing the driving frequency decision operation. Further, when the still image detection flag signal SIDFS has the second logic level (e.g., a low level), or the still flag signal SFS has the first logic level (e.g., a high level), the driving frequency decision block 220 may provide the frame data FDAT to the data driver 120 according to the driving frequency DF determined by the driving frequency decision operation.

To perform the driving frequency decision operation, in some embodiments, as illustrated in FIG. 7, the driving frequency decision block 220*a* may include a flicker lookup table 310, a segment division block 320, a segment frequency decision block 330, and a maximum frequency decision block 340.

The flicker lookup table 310 may store flicker values corresponding to gray levels (e.g., 256 gray levels from a 0-gray level to a 255-gray level). Here, the flicker value may represent a degree of a flicker perceived by a user. For example, as illustrated in FIG. 8, the flicker lookup table 310 may store, but not limited to, one flicker value with respect to four gray levels. In an example, as illustrated in FIG. 8, the flicker lookup table 310 may store a flicker value of 0 with respect to the 0-gray level to a 7-gray level, a flicker value of 40 with respect to a 8-gray level to a 11-gray level, a flicker value of 80 with respect to a 12-gray level to a 15-gray level, a flicker value of 120 with respect to a 16-gray level to a 19-gray level, a flicker value of 160 with respect to a 20-gray level to a 23-gray level, a flicker value of 200 with respect to a 24-gray level to a 27-gray level, and a flicker value of 0 with respect to a 236-gray level to a 255-gray level, but the flicker lookup table 310 according to the invention is not limited to the example of FIG. 8.

The segment division block 320 may divide the frame data FDAT into a plurality of segment data SDAT1, SDAT2, . . . , SDAT9 for a plurality of segments. For example, as illustrated in FIG. 9, the display panel 110 may be divided into first through ninth segments S1 through S9, and the frame data FDAT for the display panel 110 may be divided into first through ninth segment data SDAT1 through SDAT9 for the first through ninth segments S1 through S9, respectively. Although FIG. 9 illustrates an example where the display panel 110 is divided into the nine segments S1 through S9, the number of segments S1 through S9 according to embodiments is not limited to the example of FIG. 9.

The segment frequency decision block 330 may determine a plurality of segment flicker values corresponding to gray levels of the plurality of segment data SDAT1, SDAT2, . . . , SDAT9 by using the flicker lookup table 310, and may determine a plurality of segment frequencies SF1, SF2, . . . , SF9 for the plurality of segments according to the plurality of segment flicker values. For example, by using the flicker lookup table 310 illustrated in FIG. 8, the segment frequency decision block 330 may determine a segment flicker value of 0 with respect to each segment data having a gray level (e.g., an average gray level or a maximum gray level) from the 0-gray level to the 7-gray level or from the 236-gray level to the 255-gray level, and may determine a segment frequency of about 1 Hz according to the segment flicker value of 0. With respect to each segment data having a gray level from the 8-gray level to the 11-gray level, the segment frequency decision block 330 may determine a segment flicker value of 40, and may determine a segment frequency of about 2 Hz according to the segment flicker value of 40. With respect to each segment data having a gray level from the 12-gray level to the 15-gray level, the segment frequency decision block 330 may determine a segment flicker value of 80, and may determine a segment frequency of about 5 Hz according to the segment flicker value of 80. With respect to each segment data having a gray level from the 16-gray level to the 19-gray level, the segment frequency decision block 330 may determine a segment flicker value of 120, and may determine a segment frequency of about 10 Hz according to the segment flicker value of 120. With respect to each segment data having a gray level from the 20-gray level to the 23-gray level, the segment frequency decision block 330 may determine a segment flicker value of 160, and may determine a segment frequency of about 30 Hz according to the segment flicker value of 160. With respect to each segment data having a gray level from the 24-gray level to the 27-gray level, the segment frequency decision block 330 may determine a segment flicker value of 200, and may determine a segment frequency of about 60 Hz according to the segment flicker value of 200.

The maximum frequency decision block 340 may receive the plurality of segment frequencies SF1, SF2, . . . , SF9 from the segment frequency decision block 330, and may decide a maximum segment frequency of the plurality of segment frequencies SF1, SF2, . . . , SF9 as the driving frequency DF for the display panel. For example, as illustrated in FIG. 10, in a case where the first through ninth segment frequencies SF1 through SF9 for the first through ninth segments S1 through S9 range from about 5 Hz to about 10 Hz, the maximum frequency decision block 340 may decide the maximum segment frequency of about 10 Hz among the first through ninth segment frequencies SF1 through SF9 as the driving frequency DF for the display panel. In a case where a first frame frequency FF1 (e.g., a normal driving frequency) is about 60 Hz, and the driving frequency DF decided by the driving frequency decision block 220*a* is about 10 Hz, the driving frequency decision block 220*a* may provide the frame data FDAT to the data driver 120 in one frame period among six frame periods, and thus the display panel may be driven at the driving frequency of about 10 Hz.

Figure 11:
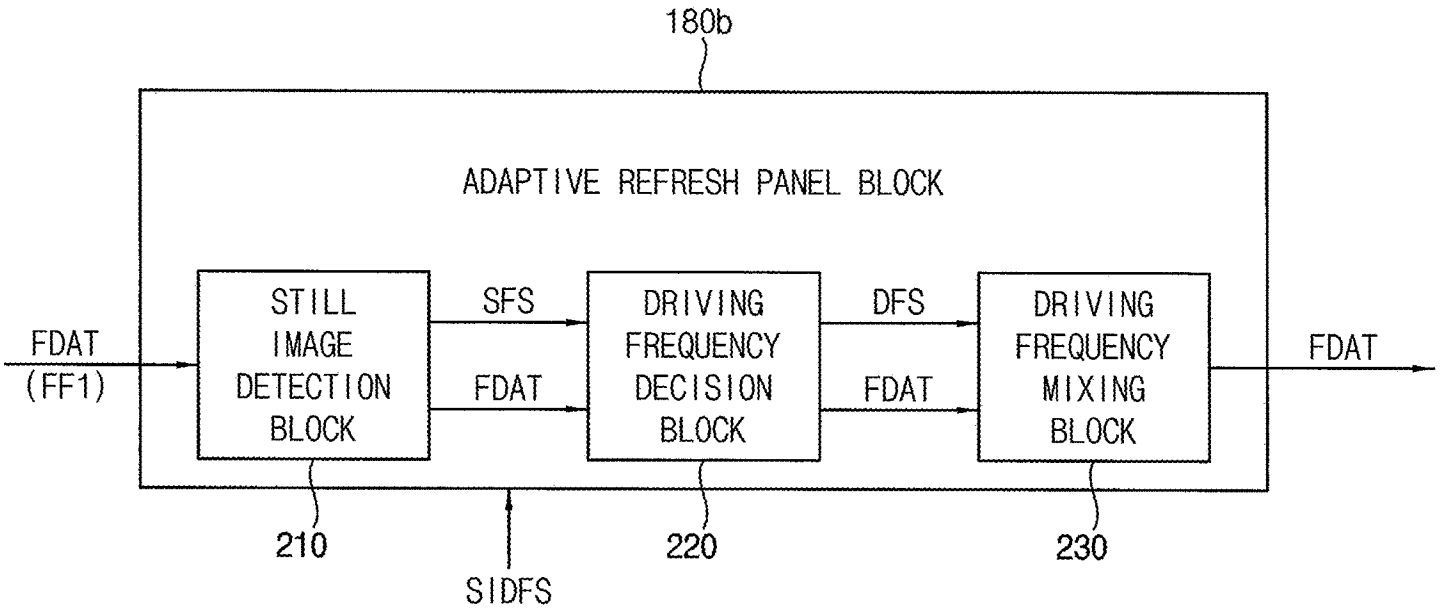
FIG. 11 is a block diagram illustrating an adaptive refresh panel block included in a display device according to embodiments.
Figure 12:
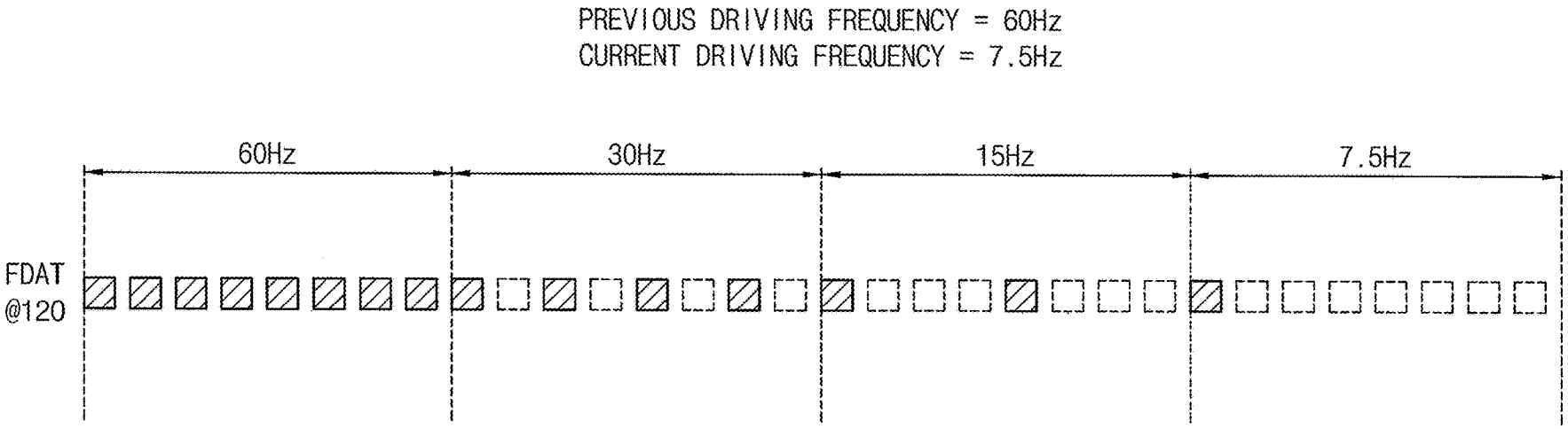
FIG. 12 is a block diagram for describing an example of a driving frequency mixing block included in a display device according to embodiments.

FIG. 11 is a block diagram illustrating an adaptive refresh panel block included in a display device according to embodiments, and FIG. 12 is a block diagram for describing an example of a driving frequency mixing block included in a display device according to embodiments.

Referring to FIG. 11, an adaptive refresh panel block 180*b* included in a display device according to embodiments may include a still image detection block 210, a driving frequency decision block 220, and a driving frequency mixing block 230. The adaptive refresh panel block 180*b* of FIG. 11 may have a similar configuration and a similar operation to an adaptive refresh panel block 180*a* of FIG. 6, except that the adaptive refresh panel block 180*b* may further include the driving frequency mixing block 230.

The driving frequency mixing block 230 may receive a driving frequency signal DFS representing a driving frequency decided by a driving frequency decision operation from the driving frequency decision block 220. In a case where a current driving frequency decided by the driving frequency decision operation is different (in some embodiments, by more than a reference frequency difference) from a previous driving frequency for the display panel 110, the driving frequency mixing block 230 may gradually change the driving frequency for a display panel from the previous driving frequency to the current driving frequency.

For example, as illustrated in FIG. 12, in a case where the previous driving frequency is about 60 Hz, and the current driving frequency decided by the driving frequency decision operation is about 7.5 Hz, the driving frequency mixing block 230 may provide eight frame data FDAT to a data driver in first through eighth frame periods to drive the display panel at about 60 Hz, may provide four frame data FDAT to the data driver in ninth through sixteenth frame periods to drive the display panel at about 30 Hz, may provide two frame data FDAT to the data driver in seventeenth through twenty-fourth frame periods to drive the display panel at about 15 Hz, and may provide one frame data FDAT to the data driver in twenty-fifth through thirty-second frame periods to drive the display panel at about 7.5 Hz. Accordingly, the driving frequency of the display panel 110 may be gradually decreased from about 60 Hz, to about 30 Hz, to about 15 Hz, and to about 7.5 Hz, and thus a flicker may be prevented from being caused by a sudden change of the driving frequency.

Figure 13:
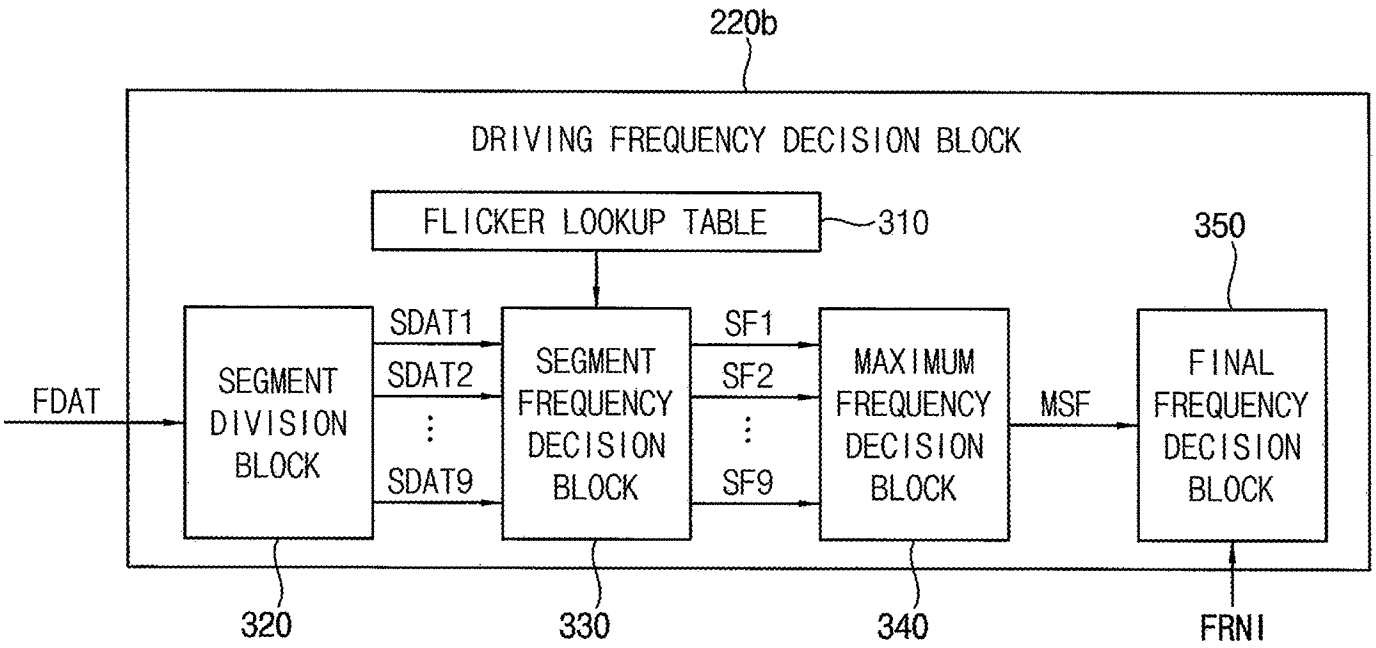
FIG. 13 is a block diagram illustrating a driving frequency decision block included in a display device according to embodiments.
Figure 14:
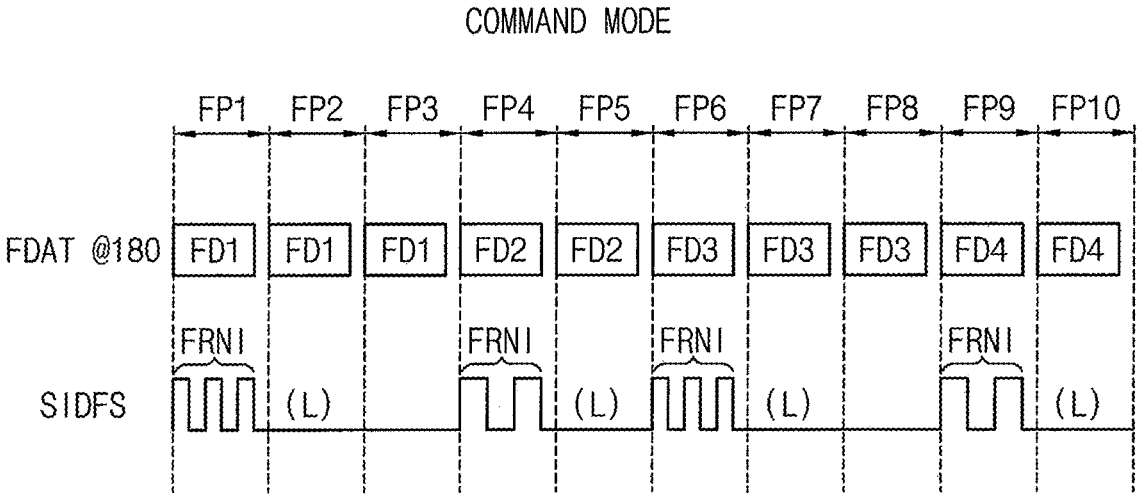
FIG. 14 is a diagram illustrating an example of a still image detection signal in a display device according to embodiments.

FIG. 13 is a block diagram illustrating a driving frequency decision block included in a display device according to embodiments, and FIG. 14 is a diagram illustrating an example of a still image detection signal in a display device according to embodiments.

Referring to FIG. 13, a driving frequency decision block 220*b* included in a display device according to embodiments may include a flicker lookup table 310, a segment division block 320, a segment frequency decision block 330, a maximum frequency decision block 340 and a final frequency decision block 350. The driving frequency decision block 220*b* of FIG. 13 may have a similar configuration and a similar operation to a driving frequency decision block 220*a* of FIG. 7, except that the driving frequency decision block 220*b* may further include the final frequency decision block 350.

An adaptive refresh panel block 180 of FIG. 1 including the driving frequency decision block 220*b* may receive, from a still image detection flag block 170 of FIG. 1, not only a still image detection flag signal SIDFS but also frame repetition number information FRNI. The frame repetition number information FRNI may represent the number of a plurality of consecutive frame periods in which the same frame data FDAT are read from the frame memory 160 in a second mode (e.g., a command mode). In some embodiments, to provide the frame repetition number information FRNI to the adaptive refresh panel block 180, the still image detection flag block 170 may provide the adaptive refresh panel block 180 with the still image detection flag signal SIDFS including a plurality of pulses, and the number of the pulses of the still image detection flag signal SIDFS may correspond to the number of the plurality of consecutive frame periods. For example, as illustrated in FIG. 14, the still image detection flag block 170 may provide, as the frame repetition number information FRNI, the still image detection flag signal SIDFS having three pulses in a first frame period FP1 where first frame data FD1 that are to be read three times from the frame memory 160 of FIG. 1 are provided, may provide, as the frame repetition number information FRNI, the still image detection flag signal SIDFS having two pulses in a fourth frame period FP4 where second frame data FD2 that are to be read twice are provided, may provide, as the frame repetition number information FRNI, the still image detection flag signal SIDFS having three pulses in a sixth frame period FP6 where third frame data FD3 that are to be read three times are provided, and may provide, as the frame repetition number information FRNI, the still image detection flag signal SIDFS having two pulses in a ninth frame period FP9 where fourth frame data FD4 that are to be read twice are provided.

The final frequency decision block 350 may receive the frame repetition number information FRNI from the still image detection flag block 170 of FIG. 1, may receive a maximum segment frequency MSF among a plurality of segment frequencies SF1, SF2, SF9 from the maximum frequency decision block 340, and may decide a driving frequency for the display panel 110 based on the frame repetition number information FRNI and the maximum segment frequency MSF. In some embodiments, the final frequency decision block 350 may decide a frame change frequency by dividing a first driving frequency or a normal driving frequency by the number of the plurality of consecutive frame periods represented by the frame repetition number information FRNI, and may decide a higher one of the maximum segment frequency MSF and the frame change frequency as the driving frequency for the display panel 110. For example, in a case where the normal driving frequency is about 60 Hz, the frame repetition number information FRNI represent three, and the maximum segment frequency MSF is about 10 Hz, the final frequency decision block 350 may decide the frame change frequency as about 20 Hz by dividing about 60 Hz by three, and may decide the driving frequency as about 20 Hz. In another example, in a case where the normal driving frequency is about 60 Hz, the frame repetition number information FRNI represent three, and the maximum segment frequency MSF is about 30 Hz, the final frequency decision block 350 may decide the frame change frequency as about 20 Hz by dividing about 60 Hz by three, and may decide the driving frequency as about 30 Hz since the maximum segment frequency MSF is bigger than the frame change frequency.

Figure 15:
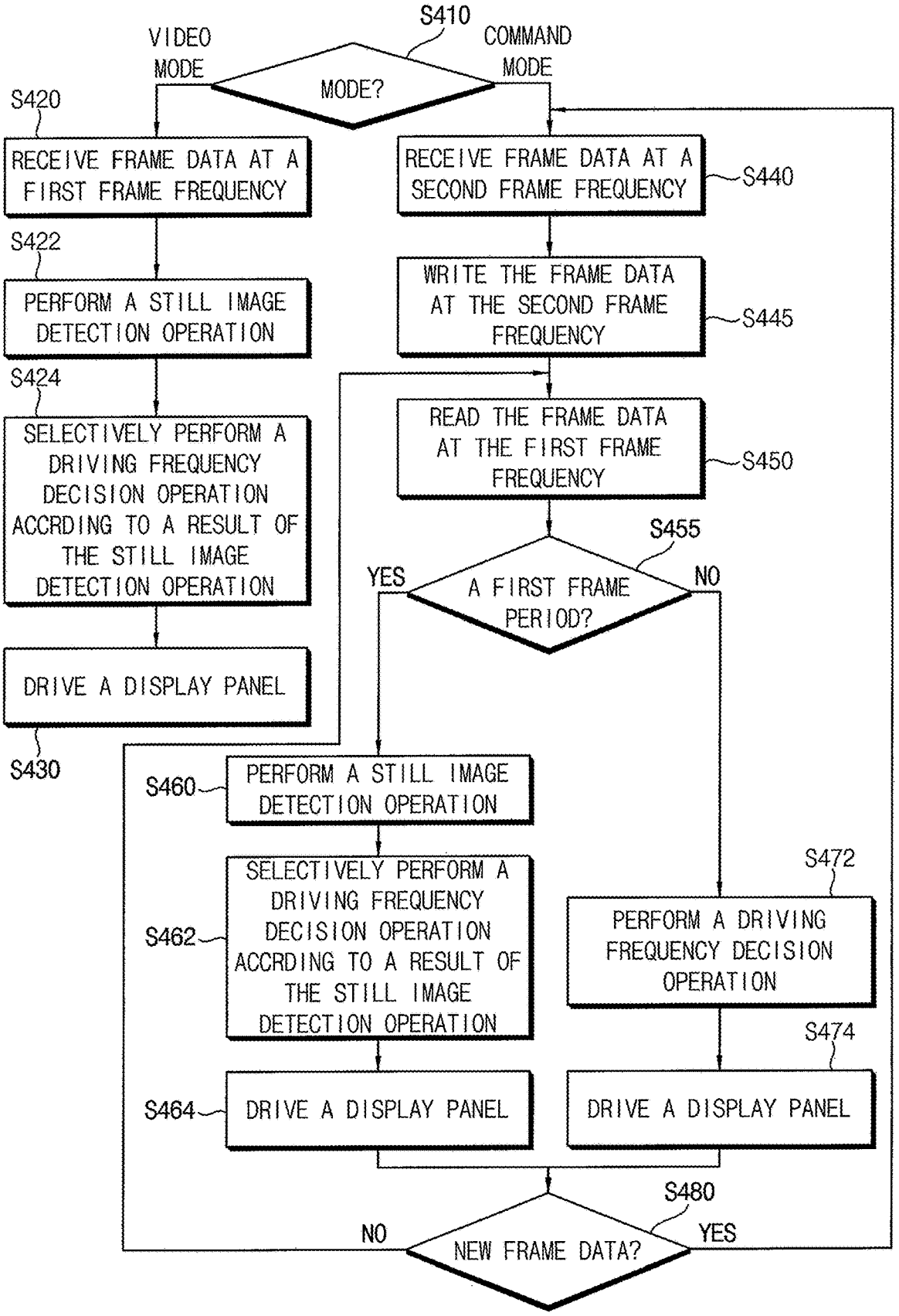
FIG. 15 is a flowchart illustrating a method of operating a display device according to embodiments.

FIG. 15 is a flowchart illustrating a method of operating a display device according to embodiments.

Referring to FIGS. 1 and 15, in a first mode (e.g., a video mode) (S410: VIDEO MODE), a receiving block 150 may receive frame data FDAT at a first frame frequency FF1 (e.g., about 60 Hz) (S420). An adaptive refresh panel block 180 may directly receive the frame data FDAT at the first frame frequency FF1 from the receiving block 150. The adaptive refresh panel block 180 may perform a still image detection operation that determines whether the frame data FDAT represent a still image (S422), and may selectively perform a driving frequency decision operation that decides a driving frequency DF for a display panel 110 by analyzing the frame data FDAT according to a result of the still image detection operation (S430). In a case where the frame data FDAT do not represent the still image, the adaptive refresh panel block 180 may not perform the driving frequency decision operation, and may provide the frame data FDAT at the first frame frequency FF1 to a data driver 120. Further, the data driver 120 may drive the display panel 110 at the first frame frequency FF1 (S430). Further, in a case where the frame data FDAT represent the still image, the adaptive refresh panel block 180 may perform the driving frequency decision operation, and may selectively provide the frame data FDAT at the driving frequency DF decided by the driving frequency decision operation to the data driver 120. Further, the data driver 120 may selectively drive the display panel 110 at the driving frequency DF decided by the driving frequency decision operation (S430).

In a second mode (e.g., a command mode) (S410: COMMAND MODE), the receiving block 150 may receive the frame data FDAT at a second frame frequency FF2 (e.g., about 24 Hz) lower than the first frame frequency FF1 (S440), and may write the frame data FDAT at the second frame frequency FF2 to a frame memory 160 (S445). The adaptive refresh panel block 180 may read the frame data FDAT at the first frame frequency FF1 from the frame memory 160 (S450).

In a first frame period among a plurality of consecutive frame periods in which the same frame data FDAT are read from the frame memory 160 (S455: YES), the adaptive refresh panel block 180 may perform the still image detection operation for the frame data FDAT (S460), and may selectively perform the driving frequency decision operation according to a result of the still image detection operation (S462). In the first frame period, in a case where the frame data FDAT do not represent the still image, the adaptive refresh panel block 180 may not perform the driving frequency decision operation, and may provide the frame data FDAT to the data driver 120 to drive the display panel 110 (S464). Further, in a case where the frame data FDAT represent the still image, the adaptive refresh panel block 180 may perform the driving frequency decision operation, and may selectively provide the frame data FDAT to the data driver 120 to selectively drive the display panel 110 (S464).

In a case where the receiving block 150 does not receive new frame data FDAT (S480: NO), in a subsequent second frame period among the plurality of consecutive frame periods (S455: NO), the adaptive refresh panel block 180 may read the frame data FDAT from the frame memory 160 (S450), and may perform the driving frequency decision operation for the frame data FDAT without performing the still image detection operation for the frame data FDAT (S472). In the second frame period, according to the driving frequency DF decided by the driving frequency decision operation, the adaptive refresh panel block 180 may selectively provide the frame data FDAT to the data driver 120 to selectively drive the display panel 110 (S474). In a case where the new frame data FDAT are received (S480: YES), the receiving block 150 may receive and write the new frame data FDAT (S440 and S445).

As described above, in the method of operating the display device 100 according to embodiments, the frame data FDAT may be written to the frame memory 160, the frame data FDAT may be read from the frame memory 160 in each of the plurality of consecutive frame periods, the still image detection operation that determines whether the frame data FDAT represent the still image may be performed in the first frame period of the plurality of consecutive frame periods, and the still image detection operation for the frame data FDAT may not be performed in the remaining frame periods of the plurality of consecutive frame periods (e.g., the subsequent second frame period of the plurality of consecutive frame periods). Accordingly, the unnecessary still image detection operation may not be performed, and a low frequency driving technique or an ARP technique may be more efficiently performed.

Figure 16:
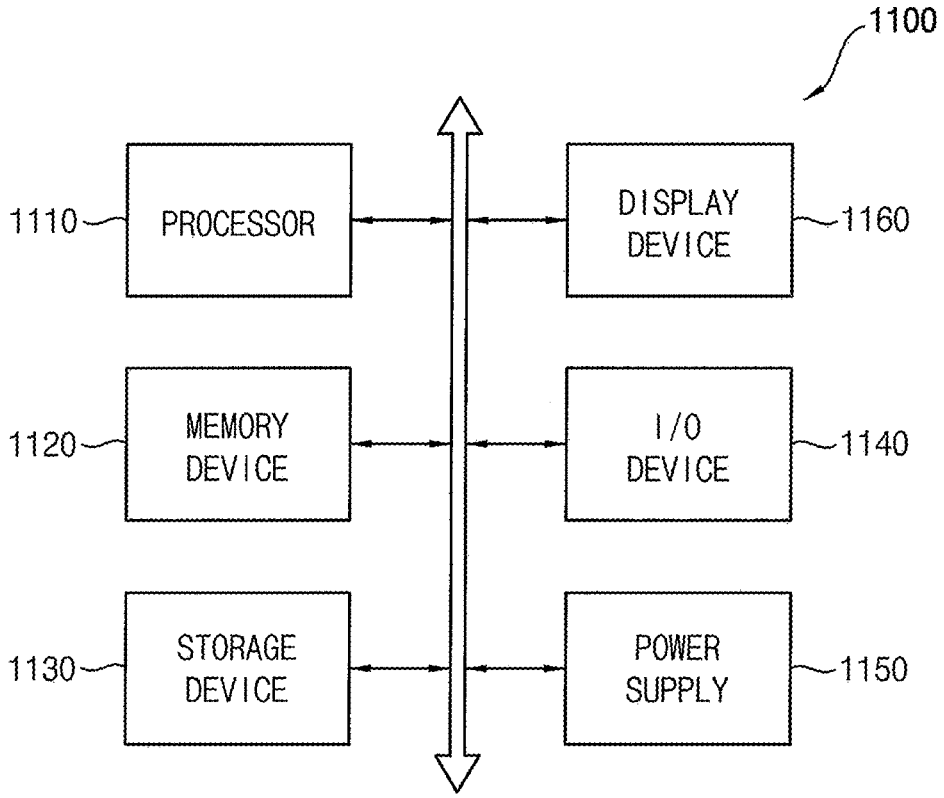
FIG. 16 is an electronic device including a display device according to embodiments.

FIG. 16 is an electronic device including a display device according to embodiments.

Referring to FIG. 16, an electronic device 1100 may include a processor 1110, a memory device 1120, a storage device 1130, an input/output ("I/O") device 1140, a power supply 1150, and a display device 1160. The electronic device 1100 may further include a plurality of ports for communicating a video card, a sound card, a memory card, a universal serial bus ("USB") device, other electric devices, etc.

The processor 1110 may perform various computing functions or tasks. The processor 1110 may be an application processor (AP), a micro processor, a central processing unit ("CPU"), etc. The processor 1110 may be coupled to other components via an address bus, a control bus, a data bus, etc. Further, in some embodiments, the processor 1110 may be further coupled to an extended bus such as a peripheral component interconnection ("PCI") bus.

The memory device 1120 may store data for operations of the electronic device 1100. For example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory (mobile DRAM) device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160, frame data may be written to a frame memory, the same frame data may be read from the frame memory in each of a plurality of consecutive frame periods, a still image detection operation that determines whether the frame data represent the still image may be performed in a first frame period of the plurality of consecutive frame periods, and the still image detection operation for the frame data may be omitted in the remaining frame periods of the plurality of consecutive frame periods (including a subsequent second frame period of the plurality of consecutive frame periods). Accordingly, the unnecessary still image detection operation may be skipped, and a low frequency driving technique or an ARP technique may be more efficiently performed.

The inventive concepts may be applied to any display device 1160, and any electronic device 1100 including the display device 1160. For example, the inventive concepts may be applied to a mobile phone, a smart phone, a wearable electronic device, a tablet computer, a television ("TV"), a digital TV, a 3D TV, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel including a plurality of pixels;

a data driver which provides data signals to the plurality of pixels; and a controller which controls the data driver, writes frame data to a frame memory, reads the frame data in each of a plurality of frame periods, performs in a first frame period of the plurality of frame periods a still image detection operation that determines whether the frame data represent a still image, and does not perform the still image detection operation in a second frame period of the plurality of frame periods subsequent to the first frame period.

2. The display device of claim 1, wherein, in the first frame period, the controller selectively performs a driving frequency decision operation that decides a driving frequency for the display panel by analyzing the frame data according to a result of the still image detection operation, and wherein, in the second frame period, the controller performs the driving frequency decision operation without performing the still image detection operation.

3. The display device of claim 1, wherein the controller includes:

a receiving block which receives the frame data;

the frame memory which stores the frame data; and an adaptive refresh panel block, wherein, in each frame period in a first mode and the first frame period in a second mode, the adaptive refresh panel block performs the still image detection operation for the frame data, and selectively performs a driving frequency decision operation that decides a driving frequency for the display panel by analyzing the frame data according to a result of the still image detection operation, and wherein, in the second frame period in the second mode, the adaptive refresh panel block does not perform the still image detection operation for the frame data, and performs the driving frequency decision operation for the frame data.

4. The display device of claim 3, wherein, in the first mode, the receiving block receives the frame data at a first frame frequency, and does not write the frame data to the frame memory, wherein, in the first mode, the adaptive refresh panel block receives the frame data at the first frame frequency directly from the receiving block, wherein, in the second mode, the receiving block receives the frame data at a second frame frequency lower than the first frame frequency, and writes the frame data at the second frame frequency to the frame memory, and wherein, in the second mode, the adaptive refresh panel block reads the frame data at the first frame frequency from the frame memory.

5. The display device of claim 4, wherein the first mode is a video mode, and the second mode is a command mode.

6. The display device of claim 3, wherein the controller further includes:

a still image detection flag block which generates a still image detection flag signal having a first logic level in each frame period in the first mode and the first frame period in the second mode, and generates the still image detection flag signal having a second logic level in the second frame period in the second mode.

7. The display device of claim 6, wherein the adaptive refresh panel block performs the still image detection operation for the frame data in response to the still image detection flag signal having the first logic level, and does not perform the still image detection operation for the frame data in response to the still image detection flag signal having the second logic level.

8. The display device of claim 6, wherein the adaptive refresh panel block includes:

a still image detection block which performs the still image detection operation that determines whether the frame data represent the still image by comparing the frame data in a current frame period and the frame data in a previous frame period in response to the still image detection flag signal having the first logic level, and generates a still flag signal having a first logic level when the frame data represent the still image; and a driving frequency decision block which performs the driving frequency decision operation that decides the driving frequency for the display panel by analyzing the frame data in response to the still image detection flag signal having the second logic level or the still flag signal having the first logic level.

9. The display device of claim 8, wherein the driving frequency decision block does not perform the driving frequency decision operation in response to the still image detection flag signal having the first logic level and the still flag signal having a second logic level.

10. The display device of claim 8, wherein the still image detection block generates the still flag signal having the first logic level when the frame data in the current frame period are substantially the same as the frame data in the previous frame period, and generates the still flag signal having a second logic level when the frame data in the current frame period are different from the frame data in the previous frame period.

11. The display device of claim 8, wherein, when the still image detection flag signal has the first logic level, and the still flag signal has a second logic level, the driving frequency decision block provides the frame data to the data driver without performing the driving frequency decision operation, and wherein, when the still image detection flag signal has the second logic level, or the still flag signal has the first logic level, the driving frequency decision block selectively provides the frame data to the data driver according to the driving frequency determined by the driving frequency decision operation.

12. The display device of claim 8, wherein the driving frequency decision block includes:

a flicker lookup table which stores flicker values corresponding to gray levels;

a segment division block which divides the frame data into a plurality of segment data for a plurality of segments, respectively;

a segment frequency decision block which determines a plurality of segment flicker values corresponding to gray levels of the plurality of segment data by using the flicker lookup table, and determines a plurality of segment frequencies for the plurality of segments according to the plurality of segment flicker values, respectively; and a maximum frequency decision block which decides a maximum segment frequency of the plurality of segment frequencies as the driving frequency for the display panel.

13. The display device of claim 8, wherein the still image detection flag block provides the adaptive refresh panel block with frame repetition number information representing the number of the plurality of frame periods in which the same frame data are read from the frame memory.

14. The display device of claim 13, wherein in providing the frame repetition number information to the adaptive refresh panel block, the still image detection flag block provides the adaptive refresh panel block with the still image detection flag signal including pulses of which the number corresponds to the number of the plurality of frame periods.

15. The display device of claim 13, wherein the driving frequency decision block includes:

a flicker lookup table which stores flicker values corresponding to gray levels;

a segment division block which divides the frame data into a plurality of segment data for a plurality of segments, respectively;

a segment frequency decision block which determines a plurality of segment flicker values corresponding to gray levels of the plurality of segment data by using the flicker lookup table, and determines a plurality of segment frequencies for the plurality of segments according to the plurality of segment flicker values, respectively;

a maximum frequency decision block which decides a maximum segment frequency of the plurality of segment frequencies; and a final frequency decision block which decides the driving frequency for the display panel based on the frame repetition number information and the maximum segment frequency.

16. The display device of claim 15, wherein the final frequency decision block decides a frame change frequency by dividing a normal driving frequency by the number of the plurality of frame periods represented by the frame repetition number information, and decides a higher one of the maximum segment frequency and the frame change frequency as the driving frequency for the display panel.

17. The display device of claim 8, wherein the adaptive refresh panel block further includes:

a driving frequency mixing block which gradually changes the driving frequency for the display panel from a previous driving frequency to a current driving frequency when the current driving frequency decided by the driving frequency decision operation is different from the previous driving frequency for the display panel.

18. A display device comprising:

a display panel including a plurality of pixels;

a data driver which provides data signals to the plurality of pixels; and a controller which controls the data driver, the controller including:

a frame memory;

a receiving block which receives frame data at a first frame frequency in a first mode, receives the frame data at a second frame frequency lower than the first frame frequency in a second mode, and writes the frame data at the second frame frequency to the frame memory in the second mode; and an adaptive refresh panel block which receives the frame data at the first frame frequency from the receiving block in the first mode, reads the frame data at the first frame frequency from the frame memory in the second mode, performs a still image detection operation that determines whether the frame data represent a still image in each frame period in the first mode and in a first frame period of a plurality of frame periods in the second mode, and does not perform the still image detection operation for the frame data in a second frame period of the plurality of frame periods subsequent to the first frame period in the second mode.

19. The display device of claim 18, wherein, in each frame period in the first mode and in the first frame period in the second mode, the adaptive refresh panel block selectively performs a driving frequency decision operation that decides a driving frequency for the display panel by analyzing the frame data according to a result of the still image detection operation, and wherein, in the second frame period in the second mode, the adaptive refresh panel block performs the driving frequency decision operation without performing the still image detection operation.

20. A method of operating a display device, the method comprising:

receiving frame data at a first frame frequency in a first mode;

performing a still image detection operation that determines whether the frame data represent a still image in the first mode;

selectively performing a driving frequency decision operation that decides a driving frequency for a display panel by analyzing the frame data according to a result of the still image detection operation in the first mode;

receiving the frame data at a second frame frequency lower than the first frame frequency in a second mode;

writing the frame data at the second frame frequency to a frame memory in the second mode;

reading the frame data at the first frame frequency from the frame memory in the second mode;

performing the still image detection operation for the frame data read from the frame memory in a first frame period of a plurality of frame periods in the second mode;

selectively performing the driving frequency decision operation according to a result of the still image detection operation in the first frame period in the second mode; and performing the driving frequency decision operation without performing the still image detection operation in a second frame period of the plurality of frame periods subsequent to the first frame period in the second mode.

* * * * *